US006069641A

United States Patent [19]

Matsuno et al.

[11] Patent Number: 6,069,641

[45] Date of Patent: May 30, 2000

[54] ION FLOW RECORDING APPARATUS AND LIQUID DEVELOPING METHOD

[75] Inventors: Junichi Matsuno, Tsuchiura; Shogo Matsumoto, Ibaraki-ken; Taisaku Seino, Tsuchiura; Yasushi Kinoshita; Akira Mori, both of Ibaraki-ken; Keiji Kamio, Hitachi; Akira Sasaki, Hitachi; Mitsuo Suzuki, Hitachi; Tetsuro Akasaki, Hitachinaka; Shigetaka Furukawa, Iwaki, all of Japan

[73] Assignee: Hitachi, Ltd., Tokyo, Japan

[21] Appl. No.: 09/027,220

[22] Filed: Feb. 20, 1998

[30] Foreign Application Priority Data

| | | | |
|---|---|---|---|
| Feb. 27, 1997 | [JP] | Japan | 9-043288 |
| Feb. 28, 1997 | [JP] | Japan | 9-045175 |
| Mar. 12, 1997 | [JP] | Japan | 9-057367 |

[51] Int. Cl.[7] ..... B41J 2/385

[52] U.S. Cl. ..... 347/115; 347/120; 347/158; 399/223; 399/227; 399/233

[58] Field of Search ..... 347/115, 117, 347/120, 154, 158; 399/57, 227, 233, 223

[56] References Cited

U.S. PATENT DOCUMENTS

| | | | |
|---|---|---|---|
| 3,003,404 | 10/1961 | Metcalfe et al. | 399/239 |
| 3,930,257 | 12/1975 | Quang et al. | 347/154 |
| 4,435,066 | 3/1984 | Tarumi et al. | 347/123 |
| 4,671,309 | 6/1987 | Iemura et al. | 399/57 |
| 4,996,425 | 2/1991 | Hauser et al. . | |
| 5,189,444 | 2/1993 | Yamada et al. | 347/153 |
| 5,253,023 | 10/1993 | Hosaka et al. . | |
| 5,367,363 | 11/1994 | Kai et al. . | |

FOREIGN PATENT DOCUMENTS

| | | |
|---|---|---|
| 6 643 338 A2 | 3/1995 | European Pat. Off. . |
| 4-107058 | 4/1992 | Japan . |
| 5-297746 | 11/1993 | Japan . |

*Primary Examiner*—Joan Pendegrass
*Attorney, Agent, or Firm*—Antonelli, Terry, Stout & Kraus, LLP

[57] ABSTRACT

An ion flow recording apparatus performs recording making density modulation every pixel. When developing on a fine grain toner is to be performed using a liquid developer for an electrostatic latent image, a developing unit (developing roller) is disposed to face a direction of gravity. Namely, a control valve is provided on a pipe for application of a developer to the developing roller or on a joint portion between the pipe and a developer tank, developing units of different two colors are joined to their developer tank portions, and a rotary shaft is provided on the joint portion to be positioned at a point of symmetry to provide alternate use of the two developing units upon turning them. Therefore, developing for a plurality of colors can be simply performed, and such turning of the developing units enables prevention of the toner from deposition in the liquid developer during developing, thereby making it possible to perform a clear recording.

8 Claims, 6 Drawing Sheets

ION FLOW RECORDING APPARATUS AND LIQUID DEVELOPING METHOD

BACKGROUND OF THE INVENTION

This invention relates to an ion flow recording apparatus in which recording is performed by making density modulation for each pixel, and more specifically to an ion flow recording apparatus in which developing of electrostatic latent images that contain half tones is faithfully performed by making use of a liquid developing process using fine grain toner to obtain high-quality images, thereby increasing the reliability while eliminating liquid leakage and expensive developer circulation system.

In a conventional apparatus disclosed in Japanese Patent Unexamined Publication No. 4-107058, an electrostatic latent image is formed on a drum by an ion flow head for controlling an ion flow, and then undergoes liquid developing in such a manner that a developing roller is partially brought into contact with a developer so that a thin film of developer is formed on the developing roller by the agency of surface tension, thereby performing the recording.

In another conventional apparatus disclosed in Japanese Patent Unexamined Publication No. 5-297746, an electrostatic latent image is formed on a drum by an ion flow head for controlling an ion flow, and then undergoes liquid developing, this sequence of formation and developing being repeated for four colors by turns to thereby perform the color recording. Developing units for respective colors are such that developing units for four colors face upward and are arranged in a horizontal row to successively perform developing for the respective colors while moving.

In still another conventional apparatus disclosed in Japanese Patent Unexamined Publication No. 55-164851, an electrostatic latent image formed on a photosensitive drum is subjected to liquid developing in such a manner that a developing roller made of a porous elastic material is partially brought into contact with a developer so that a thin film of developer is formed on the developing roller by the agency of surface tension, thereby performing the recording.

In a different conventional apparatus disclosed in Japanese Patent Unexamined Publication No. 5-204252, a belt applicator keeping a developer is moved close to an image holding belt on which an electrostatic latent image is formed, so as to develop the electrostatic latent image.

In the conventional technique described above, when an electrostatic latent image is formed on a drum- or belt-shaped charge carrying medium and developed by the liquid developing device, the developing is performed with the developing device facing upward or sideways lest the developer should leak. Therefore, there have been such restrictions that the downward developing cannot be performed directly on the charge carrying recording paper with the developing device facing downward, that the apparatus is prohibited from being tilted, and so on, and furthermore it has been necessary to provide a stirring or circulating device for the purpose of avoiding deposition or cohesion of the developer.

SUMMARY OF THE INVENTION

It is an object of the present invention to provide an ion flow recording apparatus capable of overcoming the above problems.

In order to achieve this end, a control valve is provided on a pipe disposed between a developer tank and a developing roller for applying a developer to the developing roller or on a joint portion between the pipe and the developer tank, two color liquid developing units are combined with each other with their respective developing surfaces facing diametrically opposite directions, and the two color liquid developing units are so supported as to be allowed to turn 180 degrees in such a manner that they are selectively moved close to a recording medium when recording.

Further, a coating of fluorocarbonpolymer is formed on the pipe disposed between the developer tank and the developing roller for applying the developer to the developing roller, so that rotating the developing roller allows the developer remaining on the developing roller and the developer left in the pipe to be easily removed, and the recording medium is conveyed back and forth by a conveyor belt to permit an electrostatic latent image to be developed by the downward facing developing unit.

Moreover, since the control valve is provided on the pipe disposed between the developer tank and the developing roller for applying the developer to the developing roller or on the joint portion between the pipe and the developer tank, the developer will never leak out of the developer tank through the pipe with the control valve closed.

The two color liquid developing units are combined with each other with their respective developing surfaces facing diametrically opposite directions, and the two color liquid developing units are so supported as to be allowed to turn 180 degrees in such a manner that they are selectively moved close to the recording medium when developing. Therefore even if deposition or cohesion of the developer occurs in the developer tank, turning the developing unit causes the toner contained in the developer to be dispersed again, thereby making it possible to perform the developing.

In addition, the developers remaining on the developing roller and left in the pipe after the developing process is finished are removed such that rotating the developing roller and turning the developing unit 180 degrees permits the developer remaining on the developing roller to be collected into the pipe with a blade, and then the control valve is opened to collect the developer left in the pipe. At this time, since the coating of fluorocarbonpolymer is formed in the pipe, the contact angle between the developer and the pipe is increased to thereby make it possible to completely remove the developer with ease.

By making use of the developing unit described above, it is possible to develop the electrostatic latent image with the downward facing developing unit, with the result that it becomes possible to easily and accurately convey the recording medium back and forth on an endless belt, and therefore a high quality recording becomes possible.

DESCRIPTION OF THE PREFERRED EMBODIMENTS

Figure 1:
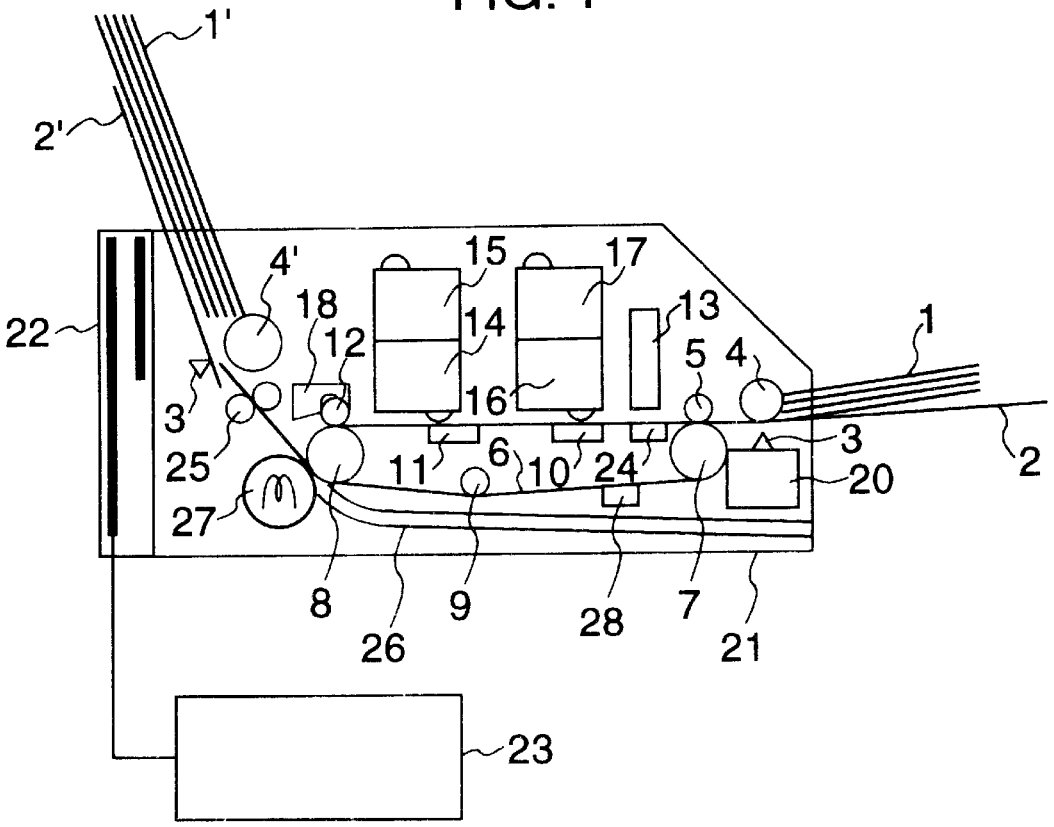
FIG. 1 is a schematic structural view of a recording apparatus according to an embodiment of the present invention.

FIG. 1 shows an embodiment of the present invention. A recording apparatus of this embodiment is shown as being of the type that performs printing after the discrimination between an exclusively specified sheet and a plain sheet, and however it goes without saying that it is possible to allow the recording apparatus to perform printing only on one of the plain sheet and exclusively specified sheet.

A plurality of exclusively specified sheets 1 and a plurality of plain sheets 1', serving as recording medium, are loaded in hoppers 2 and 2', respectively, in which state the apparatus waits for a command to start recording. A recording start command outputted from a computer 23, a control unit 22 controls the rotation of a paper feed roller 4 or 4' so as to start feeding the recording paper separately. Then, using an optical reflective sensor 3 or 3', for example, as a detecting means for judging which the recording paper is the exclusively specified sheet 1 or the plain sheet 1', the control unit 22 judges whether or not the recording medium loaded in the hopper 2 or 2' is different from the specified one. The optical reflective sensor 3, 3' detects a mark printed on the back of the exclusively specified sheet 1, which is judged by the control unit 22. The optical reflective sensor 3, 3' reads a mark made on a predetermined, non-imaged area of the exclusively specified sheet 1. Since the difference in capacitance between the recording surface of the exclusively specified sheet 1 and the surface of the plain sheet 1' is marked, it is also possible to make the aforesaid judgment with a capacitance sensor. Incidentally, the term "exclusively specified sheet" means the recording medium having a dielectric layer, the details of which will be described later.

In the case where the exclusively specified sheets 1 are loaded in the hopper 2' and an executive instruction to record is forwarded from the computer 23 to the control unit 22 of the printer, the optical reflective sensor or capacitance sensor 3' detects that a single exclusively specified sheet is about to be separated and fed. This detection signal is forwarded from the printer control unit 22 to the computer 23 which in turn outputs to the operator an information that wrong sheets are loaded, in such a manner to display the information on a display portion of the computer or of the recording apparatus, or to make sounds. It is no matter whether or not the signal is displayed to stop the recording operation in the printer apparatus as long as the printer is free from trouble.

On the other hand, in the case where the plain sheet 1' is loaded in the hopper 2 and an executive instruction to record is forwarded from the computer 23 to the control unit 22, the optical reflective sensor or capacitance sensor 3 detects a fact that a sheet of plain sheet 1' is about to be separated and conveyed. This detection signal is forwarded from the control unit 22 to the computer 23 which in turn gives the operator an information that the loaded paper is wrong. In this case, the signal is displayed and the computer 23 operates to make the printer apparatus ignore the executive instruction to record until the exclusively specified sheets 1 are loaded in the hopper 2 because the recording section of the printer is likely to be in trouble.

It is clear that such recording paper detection system works in the same manner also in printers of the type that support only either of the exclusively specified sheet 1 and the plain sheet 1'. The exclusively specified sheets 1 and the plain sheets 1' normally loaded in their hoppers are each subjected to the recording through the following process.

Recording on the exclusively specified sheet 1 is first described.

As soon as the exclusively specified sheet 1 is held between a dielectric conveyor belt 6 and a first driven pressure roller 5, it is released from a paper feed roller 4. The exclusively specified sheet 1 is conveyed at a recording process speed while being held between the conveyor belt 6 and the first pressure roller 5. When the exclusively specified sheet 1 reaches a position where an opposed electrode unit 24 and an ion flow head 13 are provided facing each other with the conveyor belt 6 therebetween, the control unit 22 supplies a control signal to the ion flow head 13 according to the print color based on a image signal from the computer 23, and then the ion flow head 13 forms an electrostatic latent image on the exclusively specified sheet 1 according to the signal forwarded thereto. Incidentally, the exclusively specified sheet is conveyed at the recording process speed until it reaches the electrostatic latent image position in this embodiment, and however it is also possible to convey at a higher speed than the recording process speed.

Before the exclusively specified sheet 1, on which the electrostatic latent image has been formed, reaches the position of one of developing units (that is, a yellow developing unit 14, a cyan developing unit 15, a magenta developing unit 16 and a black developing unit 17) corresponding to the print color, a cap of the corresponding developing unit is moved, the developing unit is lowered toward the conveyor belt 6, and one of a developing gap stay A 11 or a developing gap stay B 10 is raised toward the developing unit so as to adjust a gap between a developing roller and the exclusively specified sheet 1 to a predetermined value. Incidentally, prior to start of developing, a control valve is operated to cause a developer in the developing unit to be moved to the developing roller by an amount required for recording.

Meanwhile, it is better for the developing units to be rotated at least one revolution at the time of warming-up so as to stir the developer to eliminate deposition or the like in the developer. When the exclusively specified sheet 1 arrives at the developing unit, developing is started. After developing for the first color is over, the exclusively specified sheet 1 is again conveyed toward the ion flow head for the formation of another electrostatic latent image for the second color. An electrostatic latent image for magenta is formed as a second color electrostatic latent image, and is developed in the same manner by the corresponding color developing unit. Furthermore, developing for a third color (e.g. cyan) and then developing of a fourth color (e.g. black) are carried out. In this case, it suffices that the developing units for the first and second colors be moved up and down up, but the cyan developing unit 15 and the black developing unit 17 must be rotatingly driven in use.

Incidentally, the exclusively specified sheet 1 having undergone the developing for the first color doesn't have no trouble in formation and developing of the electrostatic latent image for the next color since a solvent contained in the developer for the first color is volatilized during the conveyance of the exclusively specified sheet 1 back to a position where the formation of the next electrostatic latent image is started.

When developing for one page is finished, the exclusively specified sheet 1 is conveyed to a heating means 18 where toner is fused to the sheet. The heating means 18 comprises heating means composed of, for example, a halogen lamp shown in FIG. 1 or a heat roller fixing means. The exclusively specified sheet 1 having undergone fixing may be forwarded onto the plain sheet hopper 2' with a timing roller 25 as paper delivery roller, or may be conveyed along a paper delivery guide 26 to be discharged through an outlet. Incidentally, the heating means 18 can be provided at the other end of the conveyor belt as well as at one end of the conveyor belt 6 as shown in FIG. 1 so as to selectively operate the fixing units depending upon the moving direction of the conveyor belt to speed up the printing process.

While formation and developing of the electrostatic latent image are carried out, a cleaner 20 is placed in a retreated position. After the color recording for one page is completed, the cleaner 20 is brought into contact with the conveyor belt 6 to perform cleaning of the conveyor belt 6. With cleaning, the conveyor belt 6 should be discharged by means of a discharger 28 in advance of cleaning.

The conveyor belt 6 is so constructed as to be able to guide and convey the exclusively specified sheet 1 or the plain sheet 1' with high accuracy. The conveyor belt 6 is extended around a driving pulley 8, a driven pulley 7 and a tension pulley 9, the driving pulley 8 being rotated with high accuracy by a driving source (not shown in FIG. 1) to cause the conveyor belt 6 to rotate.

In the operation described above, after developing for all the colors is completed, the exclusively specified sheet 1 is conveyed by means of the conveyor belt 6 and a second pressure roller 12 to the heating means 18 where the toner is fused to the paper. However, the exclusively specified sheet 1 may be conveyed every developing of one color to the fixing unit where it is fused.

Further, in the embodiment of FIG. 1, the ion flow head 13 is provided this side short of the developing unit on the delivery side of the exclusively specified sheet 1. However, the ion flow head may be provided between the two developing devices 14, 15 and 16, 17 disposed side by side. If the ion flow head is provided between the developing devices, recording and developing can be performed by moving the exclusively specified sheet or the plain sheet back and forth, in which case both formation and developing of the electrostatic latent image can be effected in the same process to increase the recording speed as compared with the case where the recording paper is moved back to the recording head position each time the electrostatic latent image is formed. Incidentally, in the present embodiment, description will be made with respect to the case where the recording is performed by the method in which the leading edge of the recording paper is returned to the writing position of the ion flow head.

Now, description will be given of the structure and operation of the primarily essential portion of the apparatus according to the present invention.

Figure 2:
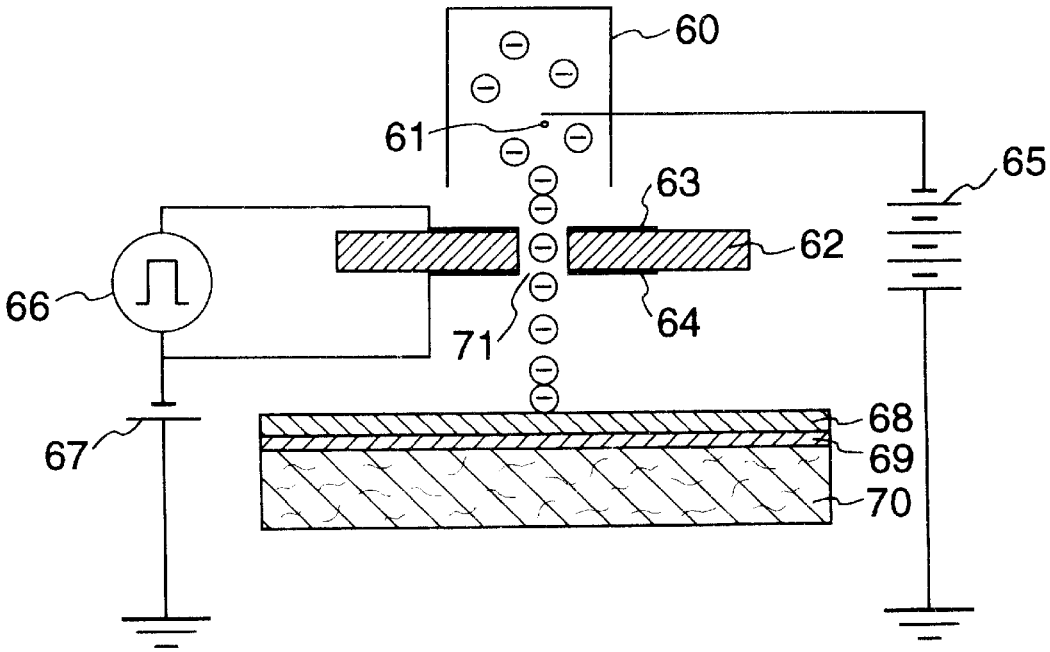
FIG. 2 is a structural view of an ion flow head according to an embodiment.

FIG. 2 shows a structure of an ion flow head according to an embodiment. First of all, referring to FIG. 2, the structure for forming an electrostatic latent image on the exclusively specified sheet will be described.

Minus ions generated by applying a high voltage of −5 to −7 kV from a negative high-voltage power supply 65 to an ion generation source, for example, a corona wire 61 disposed in a can 60 of a corotron shown in FIG. 2 are controlled by control electrodes 63, 64 having a large number of ion through holes 71 to provide an electrostatic latent image on the recording paper 1. The exclusively specified sheet 1 is composed of a dielectric layer 68, a conductive layer 69 and a recording paper base material 70, and the conductive layer 69 is electrically structured such that the negative high-voltage power supply 65 provides minus charges on the exclusively specified sheet (it also is possible to allow the conductive layer 69 to be charged from the side of the conveyor belt 6). Control electrodes 63, 64 are provided on upper and lower surfaces of a dielectric film 62, and a potential difference between the both control electrodes causes an electric field to be produced for controlling the flow rate of ion.

A control signal 66 forwarded from the computer 23, which stores image date, a voltage of the bias power supply 67 to the control electrodes 63, 64 so that the flow rate of minus inons are controlled by means of ion through holes 71. In consequence, an amount of minus ions is controlled for each pixel, and therefore the tone can be controlled.

Figure 3:
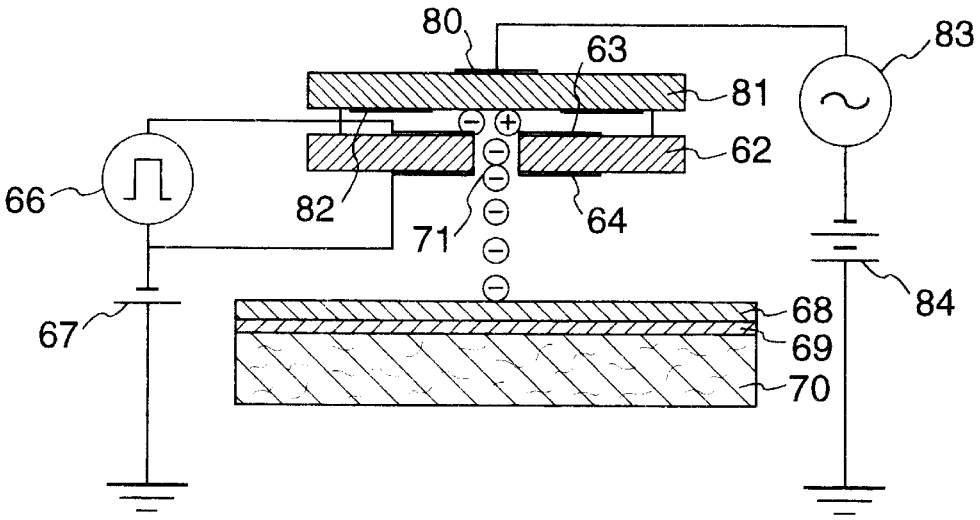
FIG. 3 is a structural view of an ion flow head according to another embodiment.

FIG. 3 shows an ion flow head according to another embodiment.

In FIG. 3, a solid state discharging electrode unit is used as the ion source. The structure shown in FIG. 3 differs from that of FIG. 2 in that the solid state discharging electrode unit comprises an upper electrode 80 and a lower electrode 82 with a solid discharge dielectric layer 81 therebetween, and that a high-voltage AC power supply 83 wired in series to a high-voltage bias power supply 84 is connected between the both electrodes so as to generate plus and minus ions. Thereafter, the control electrodes 63, 64 selectively allow only the minus ions to pass through the ion through holes 71. In consequence, an amount of negative charge is controlled every pixel to enable realizing the tone reproduction in the same manner as the corotron method shown in FIG. 2.

As described above, When the exclusively specified sheet 1 reaches a recording starting position (not shown), the ion flow head 13 positioned facing the opposed electrode unit 24 with the conveyor belt 6 and the exclusively specified sheet 1 therebetween starts to record an electrostatic latent image on the exclusively specified sheet 1 in response to a first color image signal 66. For instance, immediately after the leading edge of the exclusively specified sheet 1 has passed the ion flow head 13, the exclusively specified sheet 1 is assumed to reach the recording starting position. This positioning can also be performed based on an amount of paper fed from the optical reflective sensor 3 or by providing another optical reflective sensor in the vicinity of the ion flow head 13, although not shown in FIG. 1. In this embodiment, developing for the first color is performed by the yellow developing unit 14.

Incidentally, the exclusively specified sheet 1 can also be assumed to reach the recording starting position immediately before the trailing edge of the exclusively specified sheet 1 passes the ion flow head 13. In this case, developing for the first color is performed by the black developing unit 16.

Now, the structure and operation of the developing unit will be described.

Figure 4:
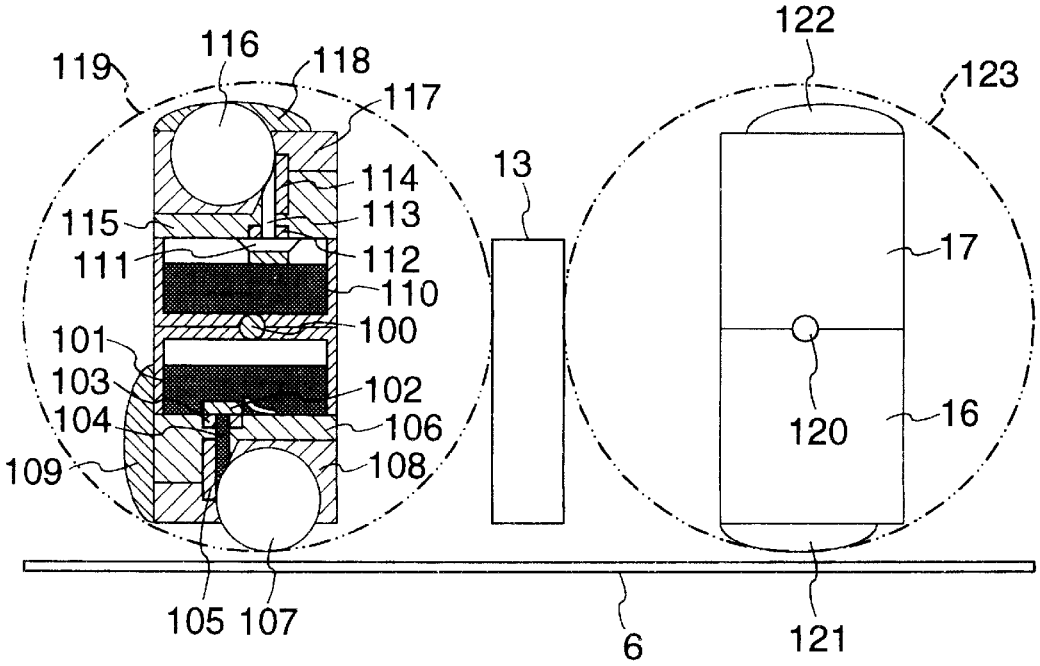
FIG. 4 is a structural view of developing units according to an embodiment of the present invention.

FIG. 4 shows a schematic structure of the developing unit according to an embodiment. In this drawing, the ion flow head 13 is disposed between the two developing devices arranged side by side, unlike FIG. 1. With such arrangement, assembly becomes easier as compared with the arrangement of FIG. 1 and hence the apparatus can be reduced in size.

The cyan developing unit 15 and the yellow developing unit 14 are connected to each other with their respective developing rollers facing diametrically opposite directions with their respective developer tanks therebetween. The magenta developing unit 16 and the black developing unit 17 are connected to each other in the same manner as well. The yellow and cyan developing units are shown in cross section.

The two-color liquid developing device are constructed such that, for example, a yellow developer tank 101 and a cyan developer tank 110 which are disposed back to back, there are provided a yellow developing roller 107, a yellow pipe 104 provided in a part of a yellow developing unit base 106, a yellow blade 105 having its portion kept close to or in contact with the yellow developing roller 107, and there are provided a cyan developing roller 116, a cyan pipe 113 provided in a part of a cyan developing unit base 115, a cyan blade 114 having its portion kept close to or in contact with the cyan developing roller 116, and a cyan control valve 111 between the cyan developer tank 110 and the cyan pipe 113. As shown in the drawing, these components are arranged with a rotary shaft 100 of the two-color liquid developing device as a point of symmetry, so that the liquid developing devices can be rotated about the rotary shaft 100 within a circumscribed circle 119. The magenta developing unit 16 and the black developing unit 17 are rotated about a rotary shaft 120 to trace a circumscribed circle 123.

A yellow control valve 102 is provided on the yellow pipe 104 disposed between the yellow developer tank 101 and the yellow developing roller 107 for applying the yellow developer to the yellow developing roller 107, or in that portion of the yellow developing unit base 106 at which the yellow pipe 104 and the yellow developer tank 101 are joined. The yellow control valve 102 is opened and closed by a yellow actuator 103 thereof.

In like manner, the cyan developing unit 15 is such that the cyan control valve 111 is disposed in that portion of the cyan developing unit base 115 at which the cyan pipe 113 is joined, opening and closing of the cyan control valve 111 being controlled by a cyan actuator 112. Namely, in the stand-by state and so on, the valve is closed to prevent the developer from flowing out of the cyan developer tank 110.

Further, in order to prevent the outflow of the developer and the adhesion of dust to the developing roller, a yellow cap 109 is provided on a yellow developing unit side plate 108 to extend from the side thereof toward the developing roller to cover the yellow developing roller 107. Similarly, a cyan cap 118 is provided on the cyan developing unit side plate 117 for protecting the cyan developing roller 116, and a magenta cap 121 and a black cap 122 are provided in the same manner. In FIG. 4, since the yellow developing unit 14 is shown as being in operation, the yellow cap 109 is removed from the yellow developing roller 107 and moved aside, while the other developing units are in the stand-by state, their respective developing rollers being covered with their own caps.

Now, the control valve will be described by taking the case of the cyan control valve.

Figure 5:
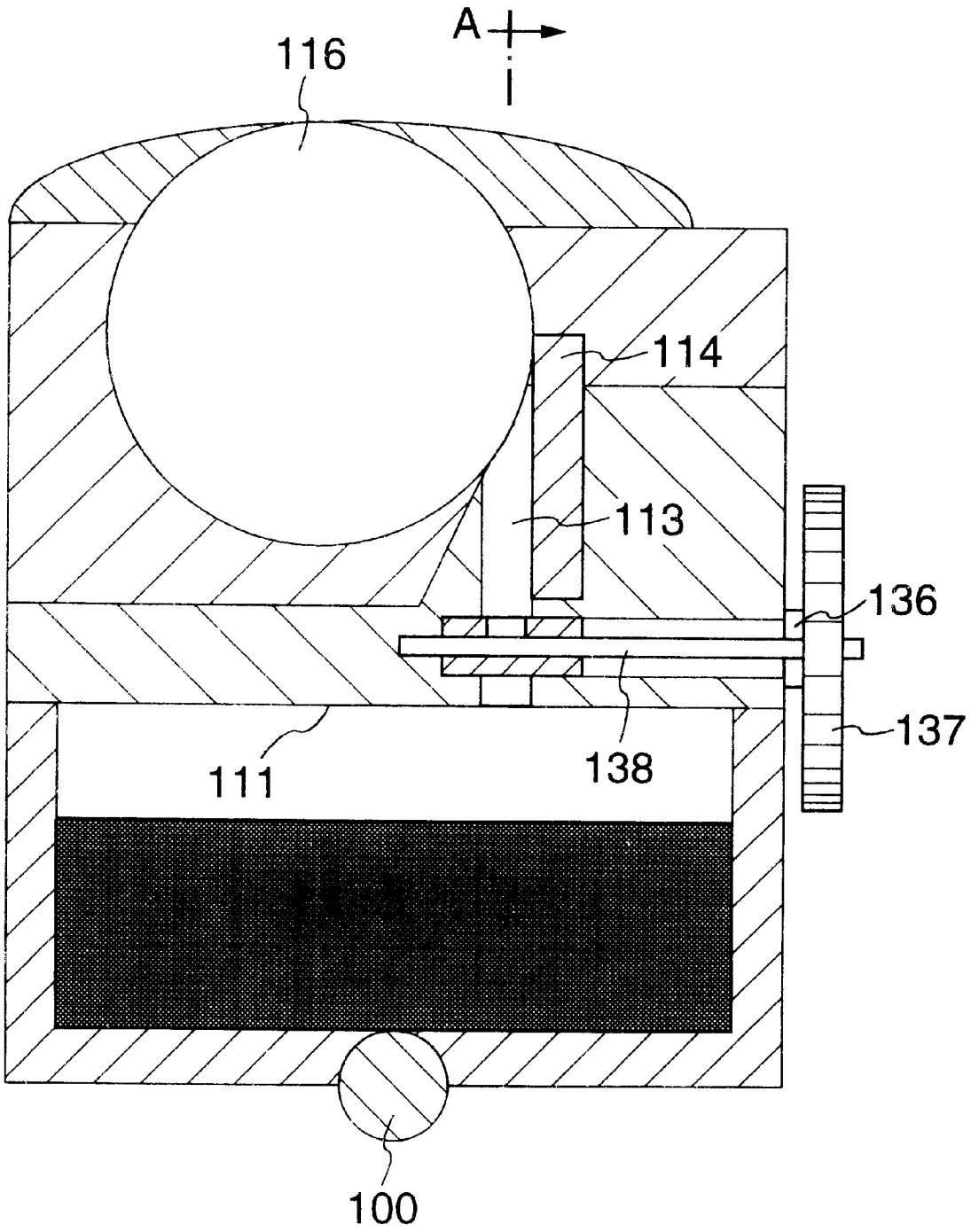
FIG. 5 is a detailed structural view of the developing unit.

FIG. 5 shows a structure of the cyan control valve, while the control valves for the other colors are constructed in the same manner. It is noted that the same components as those shown in FIG. 4 are designated by the same reference numerals.

The cyan control valve 111 is mounted on a valve shaft 138 which in turn is rotatably supported by a valve bearing 136. A valve gear 137 is mounted on the valve shaft 138 to transmit the driving force from a drive source. The control valve 111 is partially cut out in the form of a half moon, and in the case where the cut-out portion thus formed provides a developer passage in the cyan pipe 113, the developer is supplied to the developing roller 116 when the developing unit faces downward. The cyan control valve 111 is so controlled as to be closed when an amount of the cyan developer accounting for one page has been supplied to the cyan pipe 113. This is the same with the case of the other colors. Incidentally, an amount of developer to be used is determined in advance according to an amount of information to be recorded, and so may also be determined on the basis of the image data forwarded from the computer 23 or the electrostatic latent image formed on the recording medium.

At the time the yellow developing is finished, the yellow control valve 102 in the yellow developing unit 14 has already been closed by the yellow actuator 103. Further, the recording medium (the exclusively specified sheet 1) has already been separated from the yellow developing unit 14. The reason why the yellow control valve 102 is closed is that it is controlled in such a manner as to be closed when an amount of the developer used for the recording of one page has been supplied to the yellow pipe 104. In a state that the developer remains on the yellow developing roller 107, the yellow developing unit 14 and the cyan developing unit are caused to start rotating about the rotary shaft 100. At this time, the yellow developing roller 107 also continues to rotate in the direction in which it is to be rotated during developing. This prevents the developer remaining on the yellow developing roller 107 from collecting in one place to drop onto the conveyor belt 6. While the yellow developing unit 14 is rotated (together with the cyan developing unit 15, naturally enough), continued rotation of the developer roller can prevent the developer from dripping.

When the developing device comes to a state that it has been turned 180 degrees, the yellow control valve 102 is opened and the yellow developing roller 107 is rotated so that the developer remaining on the yellow developing roller 107 is collected into the pipe with the yellow blade 105. Since the yellow control valve 102 is opened, the developer left in the pipe is collected into the yellow developer tank 101. In this case, formation of a coating of fluorocarbon-polymer in the pipe increases the contact angle between the developer and the pipe to thereby make it possible to collect the developer into the yellow developer tank 101 easily and completely. When such collection is over, the yellow control valve 102 is closed and the yellow developing cap 109 is moved to cover the yellow developing roller 107.

At this time, the two-color developing devices are turned upside down, so that even if the developer has been deposited or cohered in the developer tank as a result of long-term preservation, turning the developing unit causes the toner contained in the developer to be dispersed again, thereby making it possible to perform developing.

In the developing unit having undergone recording, the control valve closely encloses the developer in the developer tank, and therefore the developer is prevented from leaking and changing in concentration attributed to the volatilization of the solvent.

With such arrangement described above, the electrostatic latent image can be developed by the developing unit, with the result that it becomes possible to easily and accurately convey the recording medium back and forth by means of an endless belt, and therefore a high quality recording can be realized.

Figure 6:
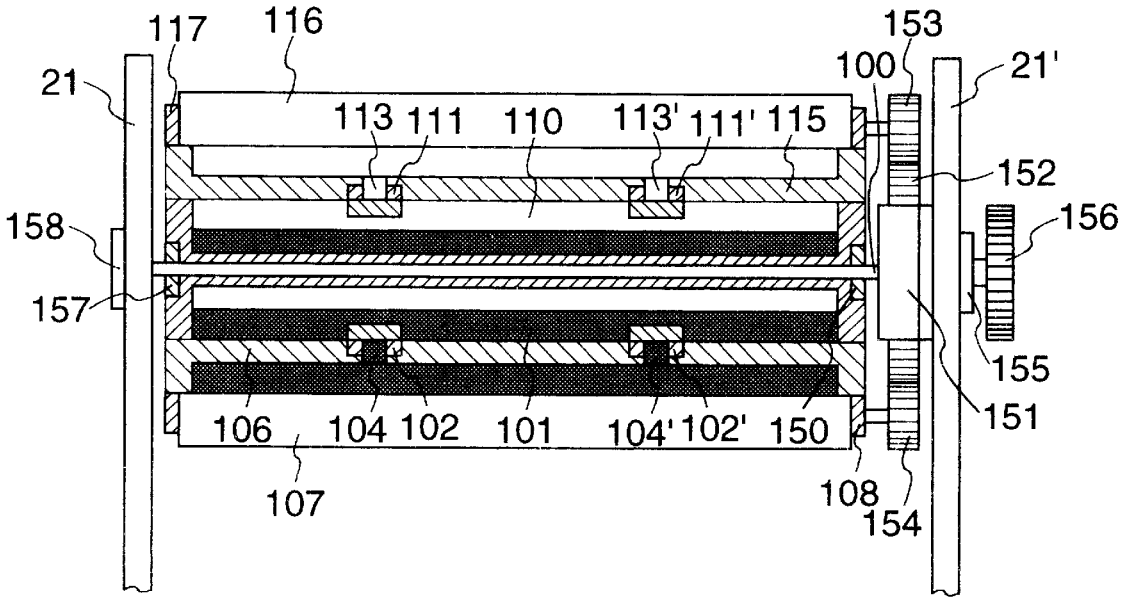
FIG. 6 is a side sectional view of the developing units.

FIG. 6 is a side view of the developing device. The yellow developer is supplied from the yellow developer tank 101 through the two yellow pipes 104, 104' so as to be applied to the yellow developing roller 107. At this time, a space defined by the two yellow pipes 104, 104', the yellow blade 105 and the yellow developing roller 107 is designed to keep the yellow developer of an amount substantially equal to that required for a full-page developing. Apparently, the same function can be achieved even with more than two pipes.

A driving force is transmitted from the rotary shaft 100 of the liquid developing device through a clutch 151 attached to a side plate 21' of the apparatus. Controlling the clutch 151 permits a turning force from a driving gear 156 to be transmitted to gears 152, 153 and 154 to cause the yellow developing roller 107 and the cyan developing roller 116 to rotate. When the clutch 151 is on, the yellow developing roller 107, the cyan developing roller 116 and the developing device are enabled to rotate. On the other hand, when the clutch 151 is off, only the gear 152 is allowed to rotate so that the yellow developing roller 107 and the cyan developing roller 116 alone are rotated. Incidentally, bearings 150, 155, 157 and 158 are provided for respective supporting portions of the shaft and supported on a side plate 21 (casing) and so on of the apparatus to rotatably support the shaft.

As described above, after the completion of the yellow developing, a developing gap stay to be described later is caused to descend and separate from the conveyor belt 6, and then the yellow cap 109 is moved to cover the yellow developing roller 107. Thereafter, the developing device is turned 180 degrees and the control valve is opened for collecting the developer remaining on the developing roller 107 into the pipe with the blade 105 while rotating the developing roller 107. The developer left in the pipe is collected into the developer tank because the control valve is opened. In this case, formation of a coating of fluorocarbonpolymer in the pipe increases the contact angle between the developer and the pipe to thereby make it possible to collect the developer into the yellow developer tank easily and completely.

At this time, the two-color developing devices are turned upside down. It is noted that turning the developing unit causes the toner contained in the developer to be dispersed again even if the developer has been deposited or cohered in the developer tank as a result of long-term preservation, thereby making it possible to perform developing.

Since the developing unit having undergone recording is brought into the stand-by state, the yellow control valve 102 and the cyan control valve 111, for example, shown in FIG. 4 closely encloses the developer in the developer tank, and therefore the developer is prevented from leaking and changing in concentration attributed to the volatilization of the solvent.

As the developing device is constructed as described above, it can develop the electrostatic latent image while facing downward, with the result that it becomes possible to easily and accurately convey the recording medium back and forth with an endless belt, and therefore a high quality image recording can be realized.

If the developing unit in operation is moved close to the ion flow head 13, a time period from formation to developing of the electrostatic latent image may be shortened to reduce attenuation of potential of the electrostatic latent image. This is effective for the high-quality recording.

Now, description will be given of the rotary movement of the developing device with reference to FIG. 7.

Figure 7:
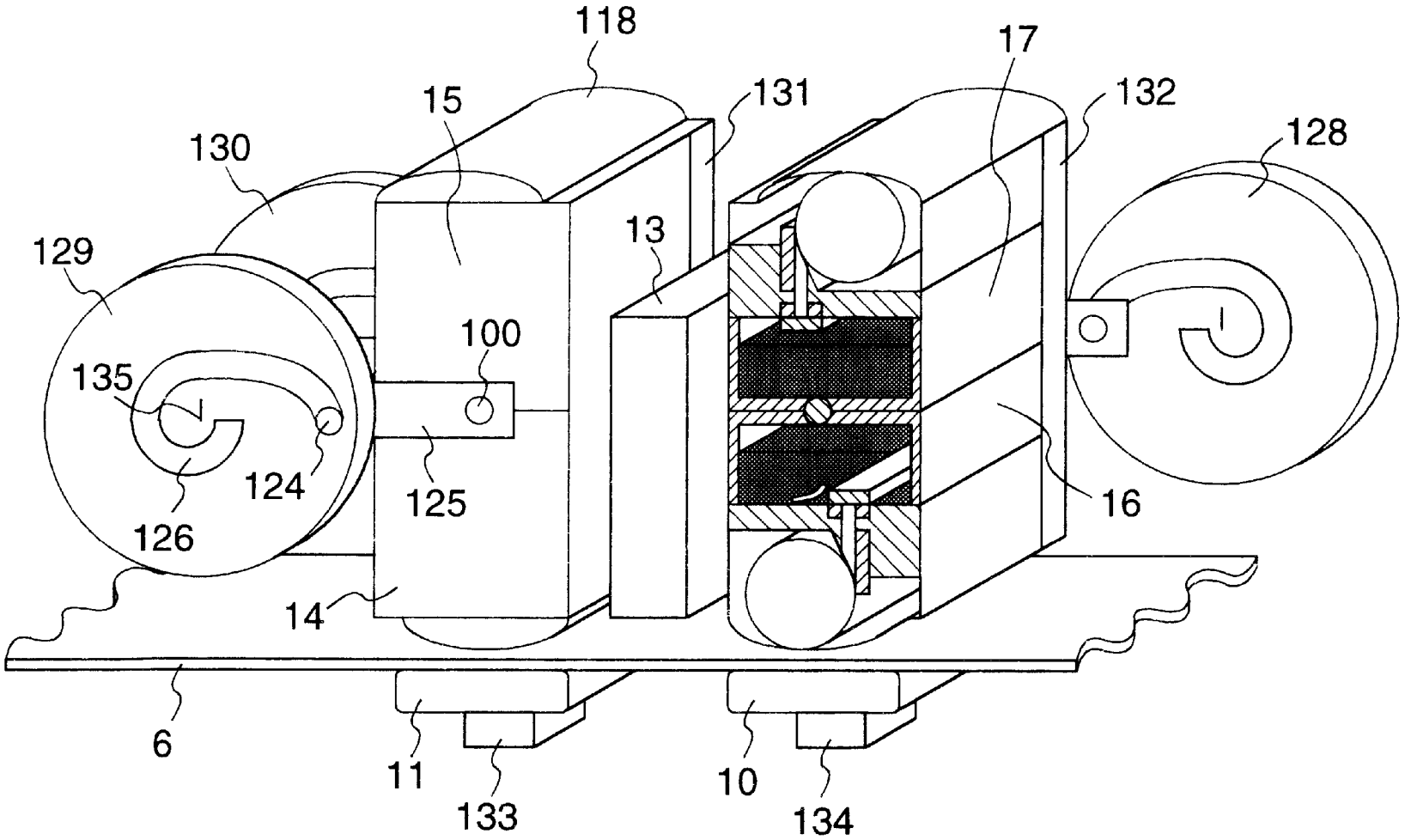
FIG. 7 is a perspective view of a developing unit section.

Turning of the developing device is realized by mounting, as shown in FIG. 7, for example, a lever 125 to the rotary shaft 100 and engaging a stem 124 attached to the other end of the lever 125 with a spiral groove 126 formed in a rotary disc 129, and rotating the rotary disc 129 about an axis of rotation 135. It is noted that such rotary discs are provided on opposite sides of pairs of the developing units.

For instance, the rotary disc 129 and a rotary disc 130 on opposite sides thereof are provided in association with the yellow developing unit 14 and the cyan developing unit 15, and the magenta developing unit 16 and the black developing unit 17, respectively, are also provided with a rotary disc on opposite sides thereof (only a rotary disc 128 is shown in FIG. 7 for the magenta developing unit 16 and the black developing unit 17).

In the case where the developing device is made stand-by or to be rotated, the developing device is moved to the position 135 remote from the ion flow head 13 to be enabled to rotate and easily realize the exchange of the developer tank and developing unit for each color. Each color developing unit including the developer tank and the developing roller can be constructed such that enables the developing unit to be exchanged as a unit as shown in FIG. 5, or another structure that enables the components of the development unit to be exchanged independently of each other, although not shown. The time, at which these units should be exchanged, can be estimated from inspection of the image quality, but a signal from a light transmission optical sensor (not shown) provided in the developer tank permits the control unit 22*b* to detect an amount of developer remaining in the tank and output an exchange time to the computer 23.

The cyan developing unit 15 and the yellow developing unit 14 are arranged to face diametrically opposite directions, and when recording the third color, the two-color liquid developing devices are turned 180 degrees so that the cyan developing unit 15 is set to face downward. Then, after a gap between the cyan developing unit 15 and the recording paper 1 is regulated by lowering the cyan developing unit 15 or by raising the developing gap stay A 11, the cyan developing is started.

Then, the recording paper 1 is conveyed to the heating means 18 where the toner image on the recording paper 1 is firmly fixed.

Formation and developing of a black electrostatic latent image are performed in the same manner to thereby form a four-color image.

Figure 8:
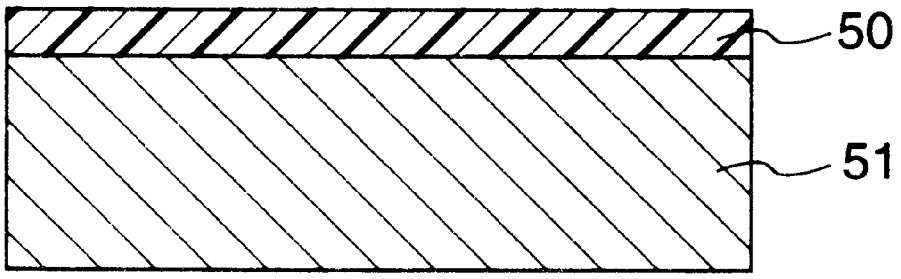
FIG. 8 is a structural view of a exclusively specified sheet.
Figure 9:
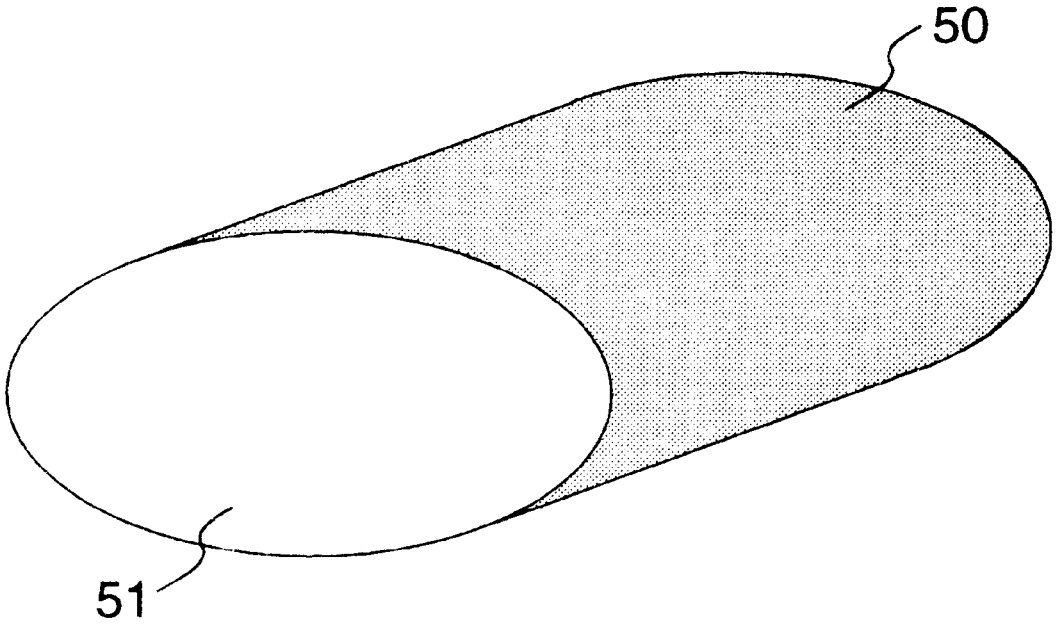
FIG. 9 is a structural view of a conveyor belt.

The dielectric conveyor belt 6 employs an endless polyimide base 51 on which a low resistance layer 50 is formed, as shown in FIGS. 8 and 9. The low resistance layer 50 is uniformly formed on the endless belt surface as shown in FIG. 8. Preferably, the low resistance layer 50 has a volume resistivity of 106 to 109 Ω cm. A desired electric resistance of the low resistance layer 50 is obtained by mixing carbon or powdered conductive metal oxide in silicon resin or fluororesin. Further, a wear resisting silicon resin, for example, may be coated on the low resistance layer 50 to a thickness of 2 to 3 $\mu$m.

Now, recording on the plain sheet 1' will be described in brief with reference to FIG. 1.

When the computer 23 forwards to the control unit 22 a control command to perform recording on the plain sheet 1', a plain sheet 1' is separately conveyed by the paper feed roller 4' until it reaches a timing roller 25 where the plain sheet 1' is stopped for a time.

Subsequently, the dielectric conveyor belt 6 is rotated in response to a first color image signal 66, and discharged by the discharge corotron 28. Then, an electrostatic latent image corresponding to yellow, for example, is formed on the dielectric conveyor belt 6 by means of the ion flow head 13. When the electrostatic latent image thus formed reaches the yellow developing unit 14, the yellow developing unit 14 is lowered to set a gap between the yellow developing unit 14 and the dielectric conveyor belt 6, and then the yellow developing is started. When yellow color developing for one page is finished, the conveyor belt 6 is circulated to the heating means 18, during which the solvent contained in the developer is volatilized.

Thereafter, the yellow developing unit 16 is made to ascend, and the conveyor belt 6 is circulated to a position where formation of another electrostatic latent image corresponding to the second color is started, that is, the leading edge of the first color toner image formed on the conveyor belt 6 reaches the ion flow head 13, during which the conveyor belt 6 is discharged by the discharge corotron 28. Meanwhile, a heating roller 27 is kept away from the dielectric conveyor belt 6 to cause no image distortion.

Then, an image signal 66 corresponding to the second color is forwarded, in response to which recording of an electrostatic latent image corresponding to magenta on the conveyor belt 6 is started. When the leading edge of the thus-formed electrostatic latent image reaches the magenta developing unit 16, the magenta developing unit 16 is lowered to set a gap between the magenta developing unit 16 and the conveyor belt 6, and then the magenta color developing is started. Upon the completion of formation and developing of the electrostatic latent image for one page, the conveyor belt 6 is conveyed to the heating means 18, during which the solvent contained in the developer is volatilized.

In like manner, formation and developing of the electrostatic latent images corresponding to cyan and black are performed, thereby finishing formation of a four-color image.

Through the process described above, a color toner image is formed on the conveyor belt 6 to be pressed against the heating transfer roller 27 with the plain sheet 1' therebetween to be transferred to the plain sheet 1'. Of course, the color toner image may be electrostatically transfered to the plain sheet 1'.

When discharge is performed by the discharge corotron 28 after the toner image has been transferred to the plain sheet 1', electrostatic attraction between the toner and the dielectric conveyor belt 6 is canceled to enable removing the remaining toner completely with the cleaner 20.

Incidentally, when the arrangement of the printer shown in FIG. 1 is to be used exclusively for plain sheets, the exclusively specified sheet hopper 2, the paper feed roller 4, the optical reflective sensor 3 and the like can be dispensed with. On the other hand, when used as a printer only for exclusively specified sheets, the plain sheet hopper 2', the paper feed roller 4', the timing roller 25, the heating transfer roller 27, the paper delivery guide 26 and the like can be dispensed with.

With the construction described above, a reliable facing-downward developing can be realized, restrictions such as prohibition on tilting of the apparatus and the need of frequent maintenance and so on are removed, and stirring or circulating devices needed to avoid deposition or cohesion of the developer are dispensed with, and therefore the recording apparatus becomes available for office and personal use.

Furthermore, a recording apparatus capable of recording on both plain sheets and exclusively specified sheets can be materialized.

According to the present invention, a liquid developing, in which fine grain toner can be employed, can be realized in both facing-upward and facing-downward positions, and a reliable developing free from leakage of the developer or the like can be performed, and therefore it is advantageously possible to materialize a recording system suitable for the ion flow recording featuring in a superior tone reproduction.

What is claimed is:

1. An ion flowing recording apparatus comprising an ion flow head for controlling a flow rate of ions from an ion source using control electrodes provided around a through hole to form an electrostatic latent image on a recording medium in response to an image signal, a conveyor belt for guiding and conveying said recording medium, and liquid developing units for developing the electrostatic image formed on said recording medium, said liquid developing units being disposed above said recording medium so that a liquid developer is supplied to a recording surface of the recording medium with a developing roller of the developing unit facing downward, said liquid developing units being arranged such that each pair of said developing units of different colors are joined with each other through developing tanks thereof with their respective developing surfaces facing diametrically opposite directions, said liquid developing units being supported in such a manner as to be able of turning 180 degrees and being selectively moved close to the recording medium when developing.

2. An ion flow recording apparatus comprising an ion flow head for controlling a flow rate of ions from an ion source using control electrodes provided around a through hole to form an electrostatic latent image on a recording medium in response to an image signal, a conveyor belt for guiding and conveying said recording medium, and liquid developing units for developing the electrostatic image formed on said recording medium, said liquid developing units being disposed above said recording medium so that a liquid developer is supplied to a recording surface of the recording medium with a developing roller of the developing unit facing downward, the ion flow head being provided between two developing devices each comprising the integrated liquid developing units of different two colors, and the recording medium being conveyed back and forth by the conveyor belt.

3. An ion flow recording apparatus comprising developing units each comprising a developer tank, a developing roller and pipe means for application of a developer to the developing roller, and wherein the developer tanks for two colors are arranged back to back, and the developing rollers and the pipes for respective colors are arranged with a rotary shaft of the two-color liquid developing units as a point of symmetry, the liquid developing units being rotatable about said rotary shaft.

4. An ion flow recording apparatus according to claim 3, wherein a coating of fluorocarbonpolymer is formed in the pipe which is provided between the developer tank and the developing roller for applying the developer to the developing roller.

5. An ion flow recording apparatus according to claim 3, further comprising a control mechanism for opening, after the developing unit is turned 180 degrees upside down after developing, a control valve to allow the developer left in the pipe disposed between the developer tank and the developing roller to return into the developer tank and then closing the control valve.

6. An ion flow recording apparatus according to claim 3, wherein the control valve is provided on the pipe or pipes disposed between the developer tank and the developing roller for application of the developer to the developing roller, or in a joint portion between the pipe or pipes and the developer tank.

7. A liquid developing method comprising controlling a flow rate of ion from an ion source using a control electrode having a through hole to form an electrostatic latent image on a recording medium in response to an image signal, and developing the electrostatic latent image thus formed with a liquid developer by means of a developing means disposed above the recording medium, characterized in that developing rollers of said developing means are supported vertically to be able to turn up and down whereby upon completion of developing, the developing rollers are turned to substantially face up, thereby allowing the developer remaining on the developing roller to be collected into a developer tank through a developer pipe or pipes.

8. A liquid developing method according to claim 7, wherein said developing means operates such that at the time of developing, the developer, an amount of which accounts for one page is supplied to the developing pipe, and then a control valve provided on said developer tank or said developer pipe is closed and, the developer is collected by, after completion of developing, turning developing rollers upward, and opening said control valve when said developing roller substantially faces upward.

* * * * *